US005174178A

United States Patent [19]

Disston, Jr.

[11] Patent Number: 5,174,178

[45] Date of Patent: Dec. 29, 1992

[54] SELECTIVE TOOL HANDLE

[76] Inventor: Horace C. Disston, Jr., 217 S. Hurffville Rd., Deptford, N.J. 08096

[21] Appl. No.: 749,865

[22] Filed: Aug. 26, 1991

[51] Int. Cl.[5] ..... B25G 1/08; B25G 1/00

[52] U.S. Cl. ..... 81/490; 81/177.4

[58] Field of Search ..... 30/490, 177.4; 81/177.4, 177.5, 490, 439, 440

[56] References Cited

U.S. PATENT DOCUMENTS

| | | | |
|---|---|---|---|
| 463,507 | 11/1891 | Goodell et al. | 81/490 |
| 707,901 | 8/1902 | Cheney | 81/490 |
| 4,372,361 | 2/1983 | Whiteford | 81/177.4 |
| 4,463,788 | 8/1984 | Corona et al. | 81/177.4 |
| 4,716,795 | 1/1988 | Corona | 81/490 |
| 4,716,796 | 1/1988 | Corona et al. | 81/490 |
| 4,815,346 | 3/1989 | Littlehorn | 81/177.4 |
| 4,976,175 | 12/1990 | Hung | 81/490 |

*Primary Examiner*—Frank T. Yost
*Assistant Examiner*—Paul M. Heyrana, Sr.
*Attorney, Agent, or Firm*—Norman E. Lehrer

[57] ABSTRACT

A tool handle for securing a plurality of tool bits and allowing for individual selection of a desired tool bit without accessing any others. The handle is comprised of an elongated, rounded body rotatably affixed to a cylindrically-shaped cap. The body has cylindrically-shaped cavities located on its periphery that slidingly secure a plurality of tool bits yet allow for visual selection of the desired tool bit. The body has a shaft end and a free cap end having an integral hub of smaller diameter than the body, the hub has a snap fit relationship with an inner rim of the cap member. The cap is substantially cylindrically-shaped having an open end and a covered end. The cap has a cylindrically-shaped inner rim for engaging the hub of the body member in a snap fit arrangement. The covered end of the cap, on its outside surface, has an access door integrally hinged to the circumference of the cap. The access door has a free swinging end with a male snap for engaging a female counterpart, located at the circumference of the cap cover on the same plane as a recess for flatly closing the access door. Under the access door and through the recess section, an access port leads to the cavities holding the tool bits. Upon visual selection of the tool bit and alignment of the port with the respective cavity, the desired tool bit can be individually removed from the handle. Subsequently, the access door can be snap closed to forestall accidental removal of undesired tool bits while the handle is in use.

8 Claims, 2 Drawing Sheets

SELECTIVE TOOL HANDLE

BACKGROUND OF THE INVENTION

This invention relates to a tool handle, and more particularly to a tool handle which secures a plurality of varying tool bits on its body such that the tool bit desired can be individually selected by use of the handle without removing more than one tool bit at a time.

Tool handles for screw drivers and other similar tools generally have a solid type body. Some tool handles have hollowed bodies for storing a variety of tool bits to be used and interchanged on some form of a chuck. Generally, to select a desired tool bit, the user is required to embark on the cumbersome task of removing all the bits from the handle, selecting the desired one, and then returning the remaining bits to the handle. However, tool handles do exist which allow for individual selection of tool bits without removing all possible choices but these designs are believed to be complicated, expensive to manufacture, or generally unsuccessful for lack of some desired feature.

There are known in the prior art tool handles having the selective feature, but none combine all the features of the instant invention nor attain a similarly effective result at such low cost. U.S. Pat. No. 707,901 to Cheney, for example, provides means for visual and individual selection of desired tool bits via a rotating cover and cavities on the periphery of the body. However, the Cheney invention fails to provide adequate means to prevent accidental removal of undesired tool bits while the handle is being used. Wetty, in U.S. Pat. No. 4,846,042, discloses a rotatable cap with a hinged cover, however, upon opening the cover, access is allowed only to a hollow cavity containing all of the tool bits which disallows individual selection of only desire tool bits without removing every one. Similarly, the rotatable feature of the cap is not for individual selection but for an ergonomic effect.

The McKenzie invention, Pat. No. 4, 974,733 is of a more complicated type and selection of desired tool bits can be difficult. McKenzie lacks the ability to visually select the desired tool bit before removal and removal is much more difficult requiring an exertion of strength by the user. As indicated by the number of drawings and their intricate details, this invention is relatively expensive to manufacture, and probably not very marketable to the layperson.

U.S. Pat. No. 4,552,043 to Corona discloses a tool handle which uses an internal mechanism for selection of desired bits which is a different and far more complicated technique than the present invention uses for changing tool bits. The tool bits are never removed from the body of the handle but are mechanically moved into place within the handle. While this feature allows selectability, it is dissimilar for it is very internally complicated and does not use a rotating cap with a securing access door to forestall accidental removal. Similar to McKenzee, as indicated by the number and details of the drawings, manufacturing expense would be relatively high leading to only limited success on the consumer market.

SUMMARY OF THE INVENTION

The present invention combines the ease of manufacture of hollowed body handles with the desired selective feature of the more complicated handles, resulting in a relatively inexpensive design having all the desired features of the prior art. The invention described is a tool handle which harbors a plurality of tool bits preferably of varying utility and allows for individual selection of a desired tool. The invention is relatively inexpensive to manufacture, easy to use, and inclusive of features found only in the more expensive and complicated designs.

In accordance with the invention, the handle comprises, in combination, an elongated rounded body member and a cylindrically-shaped cap member which are snap fit together and rotate relative to each other. The elongated member has cylindrically-shaped cavities located along and within the body's periphery which slidingly secure a plurality of tool bits yet still allow for visual selection. The cap is cylindrically-shaped having an open end and a covered end. The covered end of the cap, on its outside surface, has an access door integrally hinged to the circumference of the cap and while in its closed position, sits in a recess. The access door has a male-snap on its free end for engaging a female counterpart located at the end of the access door recess to provide for secured closure of the access door. Under the access door and through the recess section, an access port leads to the cavities holding the tool bits.

Upon visual selection of the desired tool bit and rotation of the cap for alignment of the port with the selected tool's respective cavity, the desired tool bit can be individually removed from the handle. The access door is then snapped close to forestall accidental escape of undesired tool bits.

The result is an effective device for storing numerous tool bits and individually selecting the same without removing every bit, having then to return them to the handle. There is no possibility of accidentally removing undesired tools because of the snap closing feature of the access door. The instant invention provides a simple and relatively inexpensive design to manufacture with all of the desired features.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
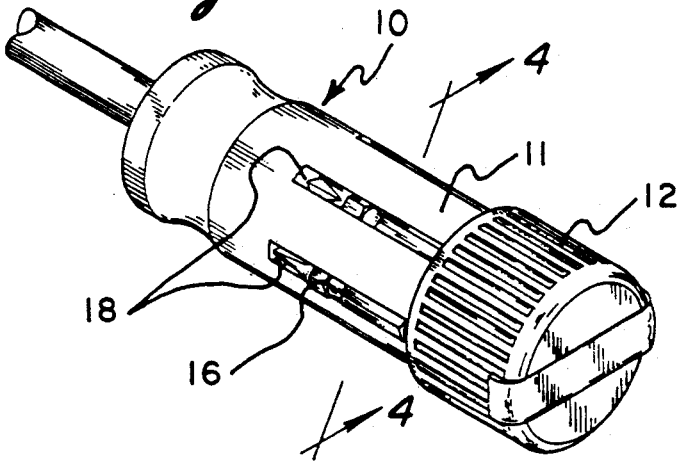
FIG. 1 is a perspective view of the assembled handle including the body, cap and tool bits.
Figure 2:
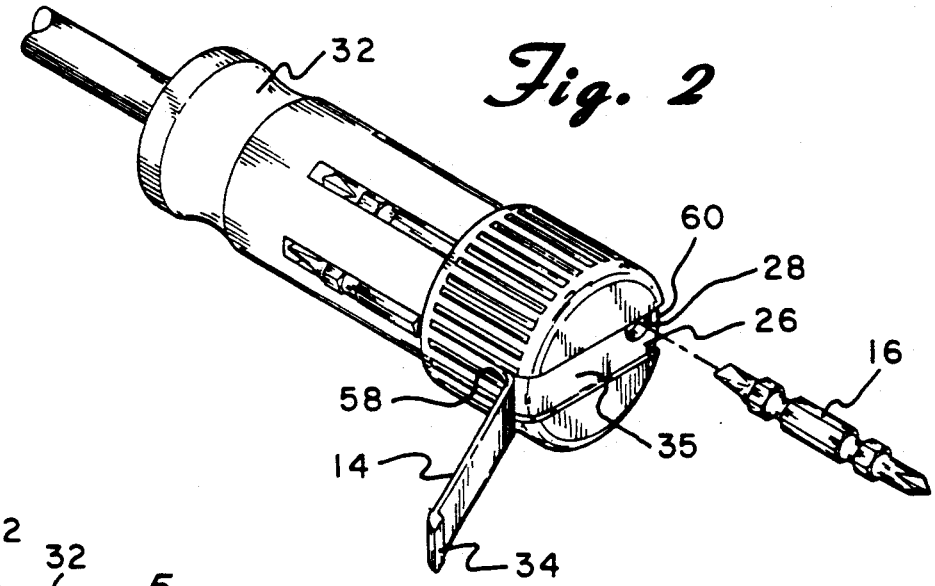
FIG. 2 is a perspective view of the assembled handle showing the removal of a selected tool bit through the access port.

Referring now to the drawings in detail wherein like reference numerals have been used throughout the various figures to designate like elements there is shown in FIG. 1 a perspective view of the assembled handle constructed in accordance with the principles of the present invention and designated generally at 10. The handle 10 is comprised of the body 11 and the cap 12. Shown also in FIG. 1, as seated in their respective cavities 18, is one example of the numerous types of tool bits 16 that the tool handle 10 can be used with. Such tool bits are inclusive of but not limited to screwdriver bits, wrench sockets, saw blades and the like. The cap 12 is affixed to the body 11 in a rotatable manner to allow the cap 12 to rotate on one end 20 of the body 11.

Figure 3:
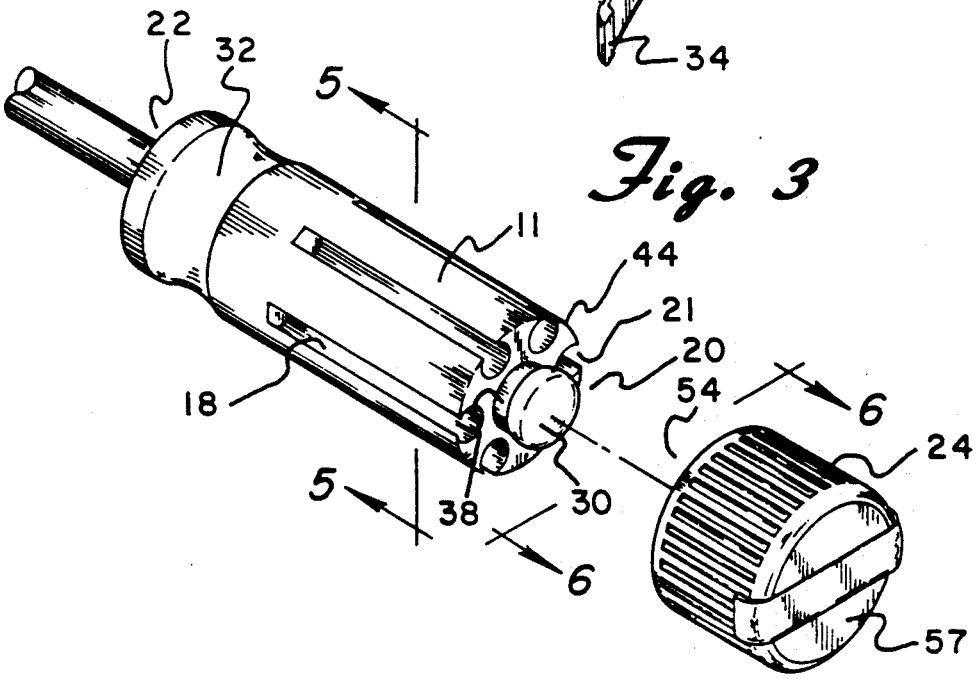
FIG. 3 is a perspective view of the cap member and body member comprising the handle.
Figure 4:
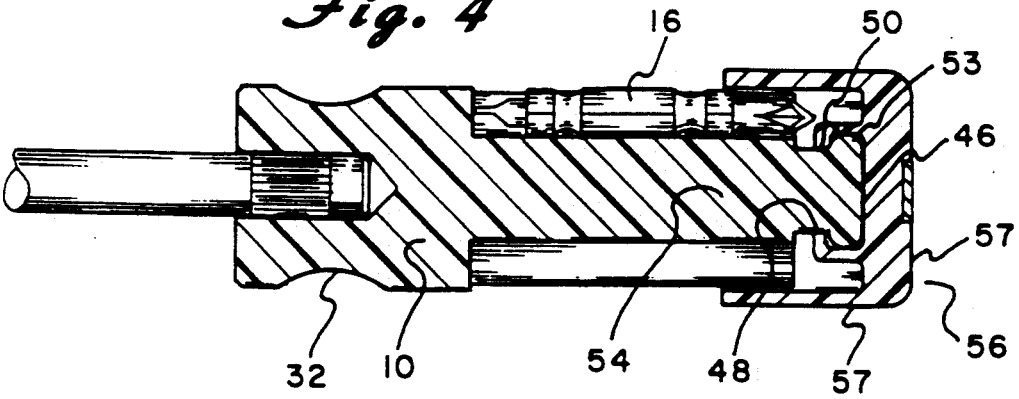
FIG. 4 is a cross-sectional view taken along line 4—4 of FIG. 1.
Figure 5:
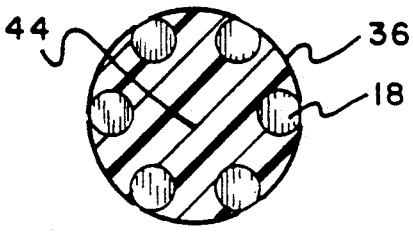
FIG. 5 is a cross-sectional view taken along line 5—5 of FIG. 3.

Referring now to FIGS. 3, 4 and 5 for further detail of the body 11 of the handle 12, as shown in FIG. 3, the body 11 is an elongated circularly-shaped member. The length of the body 11 is substantially longer than its diameter 44. The body 11 has one free end 20 and a shaft end 22 (FIG. 3). A short distance from the shaft end 22 along the body length, the body 11 has a concave contour 32, shown most clearly in FIG. 4, around its circumference 36 (FIG. 5) to provide for the user a more secure grip and an ergonomic design for the hand.

The end 20 of the body 11, as shown in FIG. 3, includes a hub 30 of smaller diameter extending axially away from the end 20 and is used for snap-attaching the cap 12 to the body 11. The hub 30 is centered on the axial centerline of the body 11 and is of a lesser diameter 46 than the body diameter 36 (FIG. 4). The hub 30 is comprised of two different diameter sections, the larger diameter section 46 and the recessed diameter section 48.

Observing the circumference 36 of the body 11, from the perspective of end 20, shown in FIG. 3, six cavities 18 are formed for slidably securing the tool bits 16. Each cavity 18 is shaped in relation to the tool bit 16 to allow for easy sliding. Each cavity 18 is also open at 21, for removal of tool bits 16, at end 20 but discontinues toward the shaft end 22. The cavities 18 extend for the length of the tool bits 16 starting from the open end 21 towards the shaft end 22. The cavities are open semicircles, shown best in FIG. 5, with the open side facing outward from the axial centerline towards the on-looking user. The open sided nature of the cavities 18 allows for visual selection of the desired tool bit 16.

Figure 6:
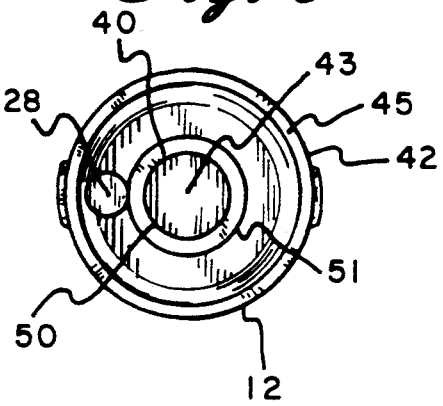
FIG. 6 is a bottom view of the cap taken along line 6—6 of FIG. 3.

The cap 12 has a circular elongated shape where the size of its diameter 42 is substantially equal to its length. The cap 12 has an open end 54 which fits over the diameter 44 of the body 11 and a covered end 56 which, on its inside surface, abuts the hub 30 while in the snap fit arrangement. Observing the cap from the open end 54 (FIG. 3), shown in FIG. 6, it is cylindrically shaped having an outer rim 45 extending to the covered end 56. The thickness of the outer rim 45 is such to sustain a rigid form. The cap 12 has a separate inner rim 40 extending axially away from the covered end 56 to the edge of the open end 54 (FIGS. 3 and 4). The inner rim 40 is comprised of two distinct inside diameter sections, the smaller diameter section 50 and the chamber diameter section 53. The chamber diameter section 53 extends substantially the axial length of the inner rim 40 until the edge portion of the inner rim 40 curves inward to the smaller or inner diameter 50. The material from which the cap is made is such that the inner diameter 50 snap fits over the hub diameter 46 of the body 11.

The larger diameter section 46 of the body snap fits through the smaller diameter section of the inner rim 40 into the relief chamber 43 and fits loosely to allow for stable rotation of the cap 12 on the hub 30. The recess diameter section 48, fits freely within the smaller diameter section 50 of the inner rim 40 to similarly allow for stable rotation of the cap 12. The length of the recessed diameter section 48 is such that when the cap 12 is attached, the smaller diameter section 50 of the inner rim 40 fits freely but securely along that length.

Referring now to FIGS. 1, 2, 4 and 7, the covered end 56 is circularly shaped and of a thickness to permit a rectangular recess 35, for flatly closing the access door 14, and an access port 28 for accessing the tool bits 16, and still maintain its structural integrity. The rectangular recess 36 runs across the cover surface 57 diameter at a width equal to that of the access door 14. The access door 14 is hinged to the circumference surface of the covered end 56 during the molding process. The access door 14 can be snap closed at the locking end 60 by way of a snap fit between the underside male extension 34 on the free swinging end of the door 14 and a female counterpart 62 at the locking end 60 on the recess 35.

Figure 7:
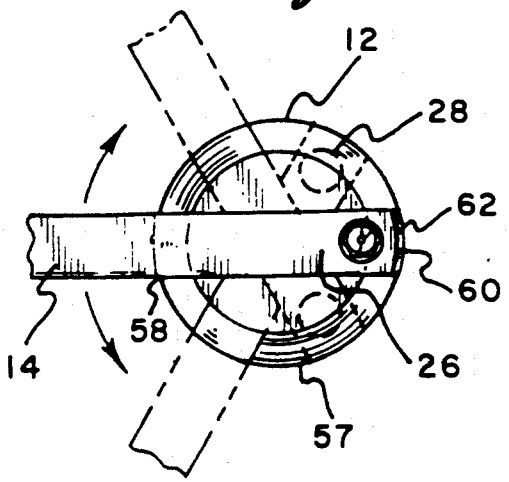
FIG. 7 is a top view of the cap with the access door in its open position and indicating the cap's rotational feature.

Towards the locking end 60 of the cap 12 on the cover end 56, shown best in FIG. 7, there is an access port 28 through the rectangular recess surface 35 of the covered end 56. The access port 28 is located and sized accordingly, on the recess surface 35, with the cap 12 being snap fit to the hub, to align with the cylindrical cavities 18 of the body 11 and to allow access and removal of the tool bits 16 through the access port 28.

A simple procedure for using the tool handle 10 will now be described. In the handle's assembled form, shown in FIGS. 1, 2 and 4, the tool bits 16 are located in their respective cavities 18 and the cap 12 is snap fit and rotatably movable relative to the body 11. The tool bits 16 are selectively removed from the body 11 by first unsnapping the snap 34 of the access door 14 and then making a visual selection of the desired instrument 16 by utilizing the open-sided semicircular cavities 18. The access port is then rotated into position over the desired instrument 16 so that the access port 28 and the respective cavity 18 are in alignment. The handle 10 is then held substantially vertically with end 20 down so that the selected tool bit 16 slides out of the body 11 through the access port 28 of the cap 12 and into the user's hand or other area of choice. The access door 14 is snap shut to forestall any accidental removal of another tool bit.

As should be readily apparent to those skilled in the art, the materials from which the handle body 11 and cap 12 are made are not critical. Substantially any plastic material having the described characteristics may be useful.

The present invention may be embodied in other specific forms without departing from the spirit or essential attributes thereof and accordingly reference should be made to the appended claims rather than to the foregoing specification as indicating the scope of the invention.

What is claimed is:

1. A tool handle for storing tool bits comprising an elongated body member having a shaft end and a free end and a rotating cap means secured to said free end thereof, said body member having a plurality of elongated slotted cavities arranged around the periphery thereof, each of said cavities being shaped to hold a tool bit therein and being open at said free end, said cap means having an access port therein rotatable with said cap mean for exposing the open end of only a selected one of said cavities and including a hinged access door means adapted to overlie said access port for allowing or prohibiting access to said port.

2. The invention according to claim 1 wherein said cavities are located on the periphery of said body member such that said tool bits are visible and a user can visually discern and select a desired one of said tool bits.

3. The invention according to claim 1 wherein said cap means is rotatably attached to said body member via a snap fit arrangement.

4. The invention according to claim 3 wherein said snap fit arrangement comprises a hub on said free end of said body member and an inner axially extending rim on said cap means, said hub having a larger diameter section an da smaller diameter section, said inner rim having a smaller diameter section and a larger diameter section, said larger diameter section of said hub and said smaller diameter section of said inner rim engaging in a snap fit relationship.

5. The invention according to claim 1 wherein said access door mean is located on said cap means and is attached thereto via a living hinge, said access door means having a free swinging end having a first snap member which engages a cooperating second snap member on said cap means.

6. The invention according to claim 5 wherein said access door means is substantially rectangularly shaped having a length substantially equal to the diameter of said cap means and having a width that is substantially smaller than the diameter of said cap means.

7. The invention according to claim 6 further including a rectangular recess in said cap means complementary to the shape of said door means for accommodating the same therein.

8. The invention according to claim 1 wherein said cavities extend for a length fully enveloping said tool bits.

* * * * *